United States Patent [19]

Fujimoto et al.

[11] Patent Number: 5,014,673

[45] Date of Patent: May 14, 1991

[54] FUEL FEED DEVICE FOR INTERNAL COMBUSTION ENGINE

[75] Inventors: Hiroaki Fujimoto; Masaki Okazaki, both of Hamamatsu, Japan

[73] Assignee: Sanshin Kogyo Kabushiki Kaisha, Hamamatsu, Japan

[21] Appl. No.: 423,020

[22] Filed: Oct. 18, 1989

[30] Foreign Application Priority Data

Oct. 19, 1988 [JP] Japan ..... 63-263341

[51] Int. Cl.[5] ..... F02M 1/08

[52] U.S. Cl. ..... 123/512; 123/513; 123/52 MB; 123/179 G; 123/180 R; 123/198 DB

[58] Field of Search ..... 123/180 R, 180 E, 179 G, 123/179 L, 187.5 R, 198 DB, 180 T, 52 MB, 512, 513

[56] References Cited

U.S. PATENT DOCUMENTS

| | | | |
|---|---|---|---|
| 1,191,062 | 7/1916 | Clark et al. | 123/180 R |
| 1,272,204 | 7/1918 | Brooks | 123/180 R |
| 1,308,237 | 7/1919 | Goff et al. | 123/180 R |
| 3,075,537 | 1/1963 | Puster | 123/198 DB |
| 4,346,683 | 8/1982 | Burke | 123/180 R |
| 4,815,427 | 3/1989 | Radtke | 123/180 E |

*Primary Examiner*—Andrew M. Dolinar
*Attorney, Agent, or Firm*—Ernest A. Beutler

[57] ABSTRACT

A fuel feed device for an internal combustion engine including a main fuel system including a charge forming device that supplies fuel, air requirements to the engine for most running conditions. An automatically operated auxiliary supply system is provided for supplying additional fuel and, in some instances, air to the engine in response to specific running conditions such as cold starting or cold enrichment. This system includes an automatically operated valve for controlling the fuel discharge. A manual override valve is provided that will permit manual selection of fuel enrichment or will shut off the fuel enrichment regardless of the condition of the automatic valve.

13 Claims, 5 Drawing Sheets

FUEL FEED DEVICE FOR INTERNAL COMBUSTION ENGINE

BACKGROUND OF THE INVENTION

This invention relates to a fuel feed device for an internal combustion engine and more particularly to an improved arrangement for automatically supplying additional fuel under certain specific engine conditions and also for permitting manual override of this additional fuel supply to permit either the supply or the termination of the supply of additional fuel manually.

It is well known that the fuel requirements of an internal combustion engine vary widely during its various running conditions including starting, cold starting and cold running. Although it is possible to provide a single charge forming system that will supply the appropriate amount of fuel under all these conditions, the tailoring of the main fuel supply to suit all the conditions which the engine may encounter can render it quite complicated. Therefore, as disclosed in copending application entitled "Fuel Supply for Plural Cylinder Engine", Ser. No. 345,614, filed Apr. 14, 1989 and assigned to the Assignee of hereof, there is disclosed an improved supplemental fuel supply system for introducing fuel to the engine under specific running conditions. This supplemental fuel supply system is operated by an automatically controlled valve. Such arrangements have obviously great utility.

However, when the automatic control is incorporated there is always a danger that the automatic control may malfunction. Although arrangements have been provided for permitting enrichment in the event of such failure, these devices do no permit either enrichment or shutting off of the enrichment in the event the automatic control provides enrichment when it is not required due to some malfunction.

It is, therefore, a principle object of this invention to provide an improved fuel feel device for an internal combustion engine that is automatic in operation but which also has a manual override that will permit either the supply of additional fuel or the discontinuance of the supply of additional fuel manually.

It is a further object of this invention to provide a manual override for an automatic fuel supply service that permits the supply of additional fuel to be either initiated or discontinued regardless of the failure mode of the automatic system.

SUMMARY OF THE INVENTION

This invention is adapted to be embodied in a fuel feed system for an internal combustion engine that is comprised of a fuel source, a fuel discharge for delivering fuel to the engine and automatic valve means for automatically controlling the connunication of the fuel source with the fuel discharge for delivering the fuel to the engine in response to a sensed condition. Manually operated valve means are provided for selectively communicating the source with the fuel discharge or for precluding delivery of fuel from the source with the fuel discharge regardless of the condition of the automatic valve means.

DETAILED DESCRIPTION OF THE PREFERRED EMBODIMENTS OF THE INVENTION

Figure 1:
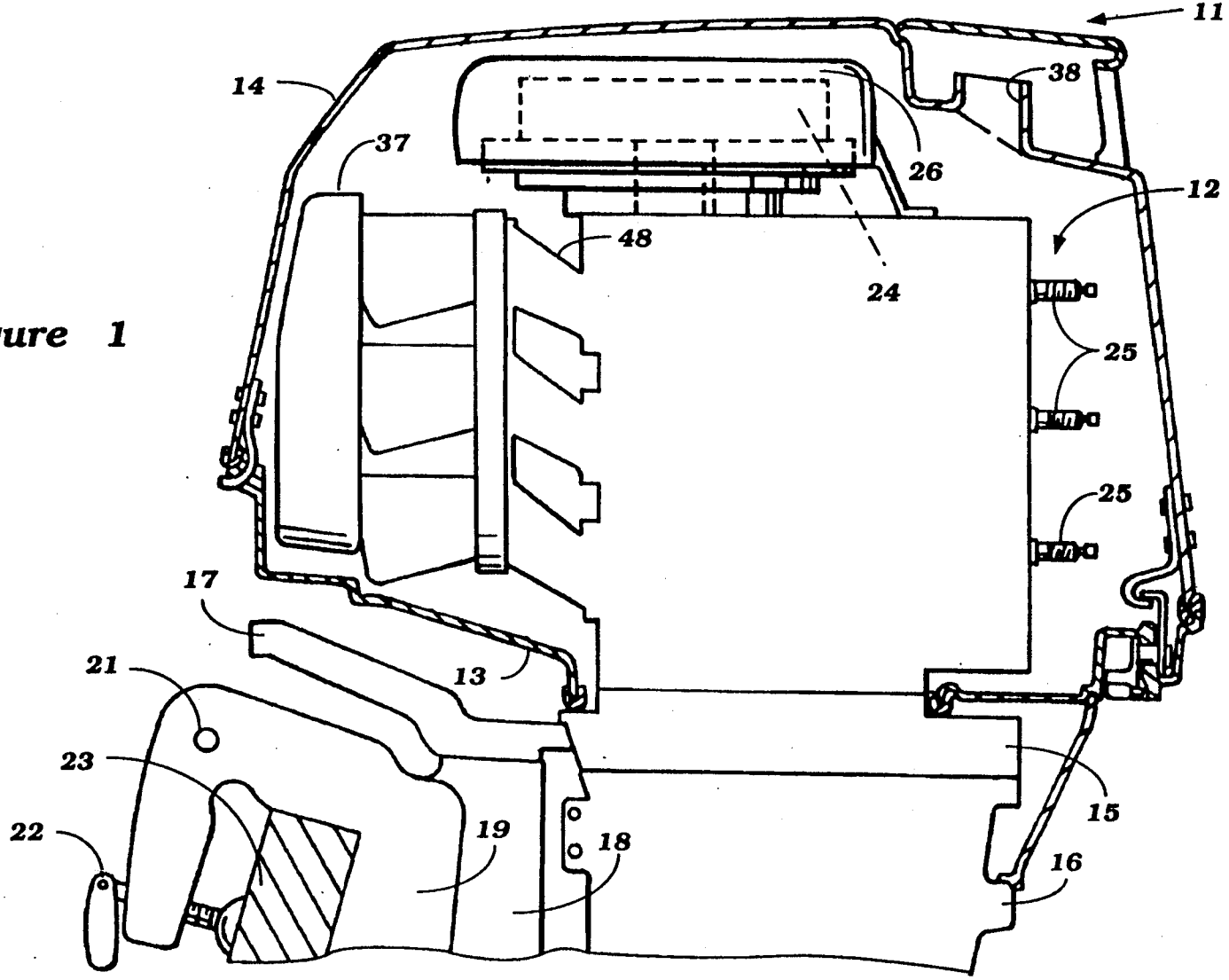
FIG. 1 is a partial side elevational view of an outboard motor constructed in accordance with an embodiment of this invention as attached to the transom of an associated watercraft, with a portion broken away.

Referring first to FIGS. 1 through 6 and initially primarily to FIG. 1, an outboard motor constructed in accordance with an embodiment of the invention is identified generally by the reference numeral 11. The invention is described in conjunction with an outboard motor because the illustrated embodiments all deal with two-cycle crankcase compression engines and such engines are typically employed with outboard motors. It is to be understood, however, that the invention can be utilized in conjunction with engines used or other purposes and also in conjunction with engines other than those operating on two cycle principle.

The outboard motor 11 includes power head that is comprised of an internal combustion engine 12 that is surrounded by a protective cowling comprised of a lower tray 13 an a main cover portion 14 that is detachably connected to the tray 13 in a known manner.

As will become apparent in the description of the remaining figures, the engine 12 is supported so that is output shaft rotates about a vertically extending axis and the engine 12 is affixed to the upper side of a spacer plate 15. A drive shaft driven by the engine output shaft extends through the spacer plate 15 and into a drive shaft housing 16 that is affixed to the underside of the spacer plate 15. This drive shaft extends to a lower unit (not shown) so as to drive a propeller or other form of propulsion device in a known manner.

The outboard motor 11 further includes a steering shaft (not shown) having a steering tiller 17 affixed to its upper end. This steering shaft is journaled for steering movement within a swivel bracket 18 for steering of the outboard motor 11 in a known manner. The swivel bracket 18 is pivotally connected to a clamping bracket 19 by means of horizontally extending pivot pin 21 for tilt and trim adjustment of the outboard motor. A clamping device 22 is carried by the clamping bracket 19 for attachment of the outboard motor 11 to a transom 23 of an associated watercraft which is only shown partially.

A flywheel magnet 24 is affixed to the upper end of the engine output shaft and fires series of spark plugs 25, one for each cylinder, by means of a suitable ingnition system. The flywheel magnet 24 is covered by a cover plate 26 that is affixed to the cylinder block of the engine.

Figure 2:
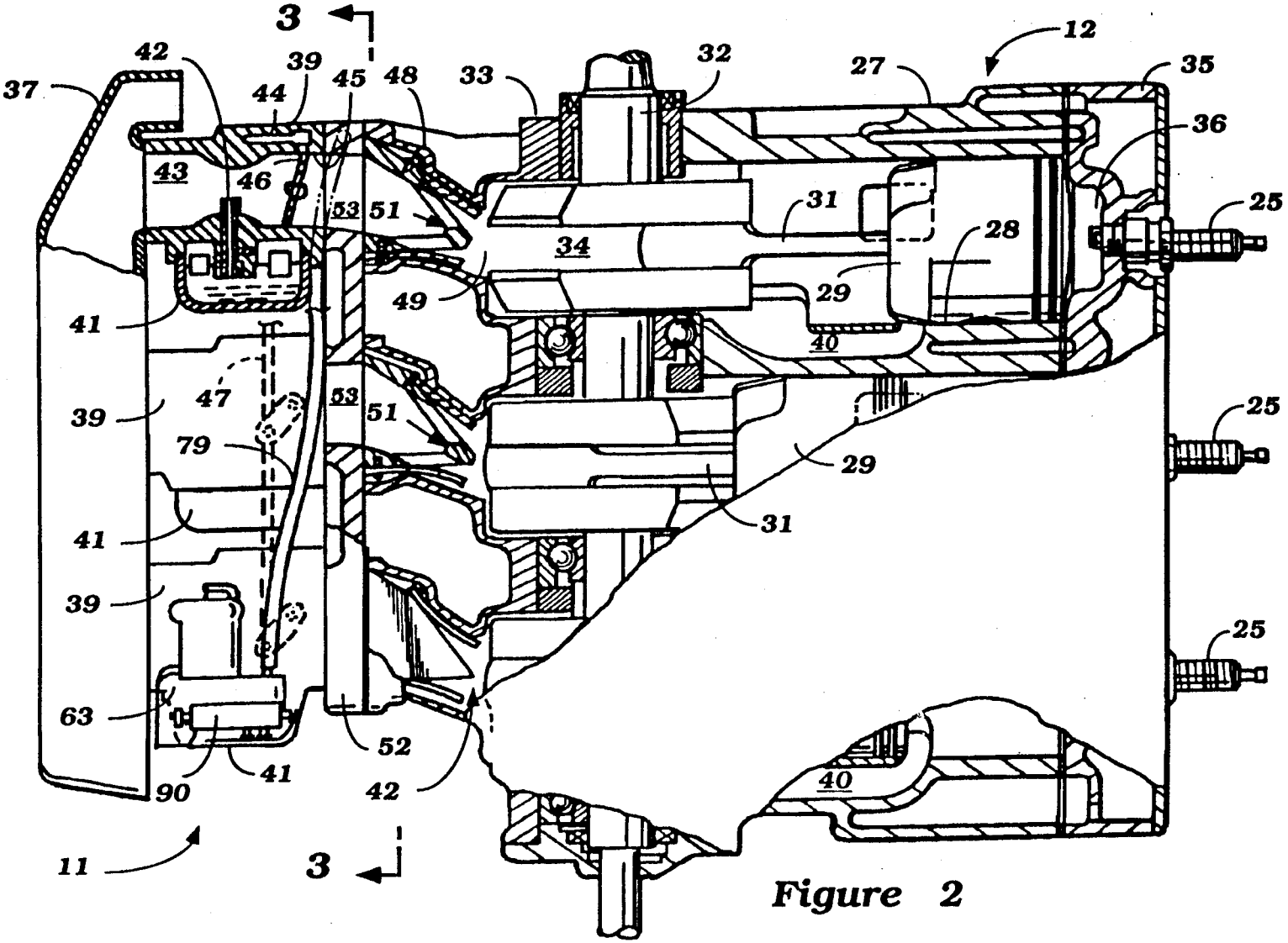
FIG. 2 is an enlarged side elevational view of the engine, with portions broken away and shown in sections.
Figure 3:
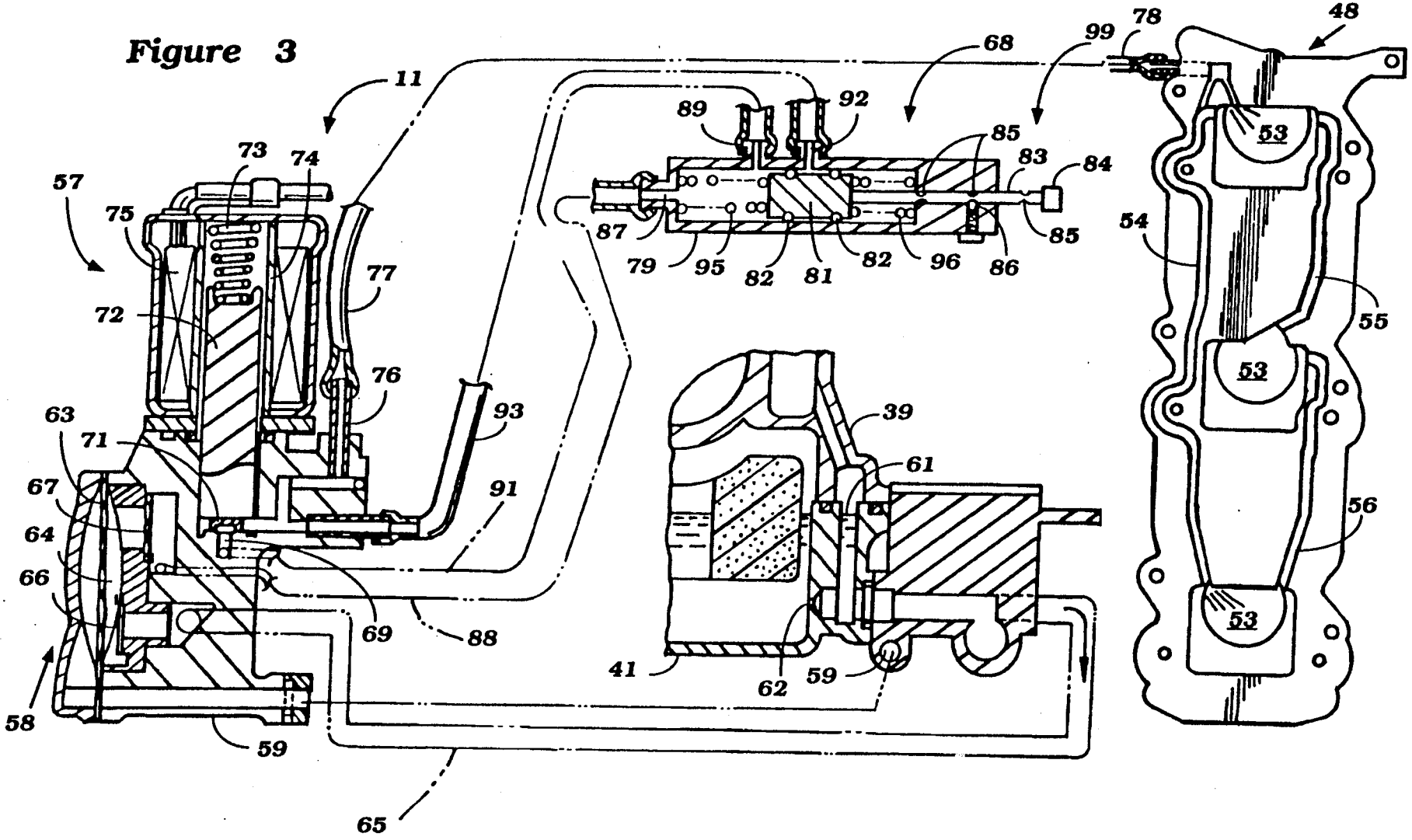
FIG. 3 is a partially schematic, partially cross sectional view taken along the line 3—3 of FIG. 2 and showing the fuel feed system of the supplemental fuel arrangement.
Figure 4:
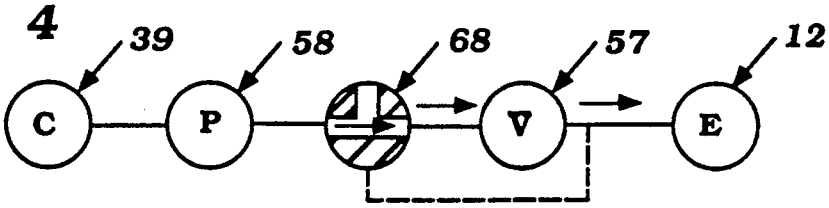
FIG. 4 is a schematic view showing the system of FIG. 3 in the position of the manual valve wherein automatic control is operative.

Referring now primarily to FIGS. 2 and 3, it will be seen that the engine 12 is comprised of a cylinder block 27 in which a plurality of cylinder bores 28 are formed. In the illustrated embodiment, the engine 12 is of the three cylinder, in line type although the invention can be utilized in conjunction with engines having other than three cylinders. However, the invention has particular utility in conjunction with engines that have multiple chambers such as multiple cylinders in the case of reciprocating engine.

Pistons 29 are supported for reciprocation within each of the cylinder bores 28 and are connected by means of connecting rods 31 to a crankshaft 32. The crankshaft 32 is rotatably journaled between the cylinder block 27 and a crankcase 33 about a vertically extending axis as aforenoted. As is conventional with tow-cycle internal combustion engines, the crankcase 32 forms a plurality of crankcase chambers 34, each associated with a respective of the cylinder bores 28 with the crankcase chambers 34 being sealed from each other in a suitable manner.

A cyclinder head 35 is affixed to the cylinder block 27 in a known manner and difines individual recesses 36 which cooperate with the pistons 29 and cylinder bores 28 to provide chambers which vary in volume as the pistons 29 reciprocate. These chambers 36 may be referred to as the combustion chambers.

A charge forming system is provided for delivering fuel/air charge to each of the individual crankcase chambers 34. The charge is compressed in the crankcase chambers 34 and delivered to the combustion chambers 36 through scavenge passages 40. In this embodiment, this charge forming systems includes an air inlet device 37 that draws atmospheric air from the area within the protective cowling of the outboard motor. Air is admitted to this internal chamber through a suitable external air inlet such as the inlet 38 shown in FIG. 1.

The air inlet device 37 supplies air to a plurality of carburetors, each of which is indicated by the reference numeral 39. Each carburetor 39 is comprised of a fuel bowl 41 to which fuel is supplied by means of an appropriate fuel supply system and in which fuel is maintained at a level head by means of a float operated valve. A main fuel discharge nozzle 42 extends from the fuel bowl 41 into a venturi section 43 of the carburetors 39.

Each carburetor 39 further includes an idle fuel discharge system that is supplied from the fuel bowl 41 in a known manner that includes a passageway 44 and discharge port 45. The discharge ports 45 are located in proximity to throttle valves 46 that are positioned downstream of the venturi sections 43 and which control the flow of fuel/air mixture supplied to the engine in a known manner. The throttle valves 46 are all linked together by means of a linkage system 47 so that their movement will be synchronized.

In conventional engine practice, the carburetors 39 communicate directly with an intake manifold, indicated generally by the reference number 48 and which has a plurality of individual intake passage 49, each of which serves a respective one of the crankcase chamber 34. Reed type check valves 51 are positioned in each of the manifold passages 49 so as to preclude reverse flow through the manifold passage 49.

A spacer plate 52 in interposed between the carburetors 39 and the manifold 48. The spacer plate 52 has individual passageways 53 that provide communication between the carburetor flow passages and the manifold passages 49. Furthermore, and as best seen in FIG. 3, the spacer plate 42 is formed with a plurality of balance passages 54, 55 and 56 that communicate the passages 53 with each other. The balance passages 54, 55 and 56 tend to dampen the variations in vacuum pressure ratio within the intake passages 53 and those passages 49 of the manifold as described in the aforenoted copending application.

In accordance with the invention, supplemental fuel for certain running or ambient conditions is supplied to the balance passages or certain of them in order to respond to a predetermined condition. In this particular embodiment, the supplemental fuel is supplied so as to assist cold starting and/or cold running.

A supplemental fuel enrichment device, indicated generally by the reference numeral 57, is provided for this purpose. The enrichment device 57 includes a diaphragm type pump 58 that is actuated by pressure variations in one of the crankcase chambers through a conduit, shown schematically at 59. Fuel is delivered to the pump 58 from a well 61 formed in one of the carburetor bodies and which receives fuel from its fuel bowl 41. The well 61 is supplied with fuel from the fuel bowl 41 through a metering jet 62, for a purpose to be described.

The diaphragm pump 58 includes a diaphragm 63 that defines a pumping chamber 64 to which fuel is delivered from the well 61 through a conduit 65 and a delivery check valve 66. When the pumping chamber 64 is decreasing in volume, the fuel is expelled through a delivery check valve 67 into a bypass valve assembly indicated generally by the reference numeral 68 which, in turn, delivers this fuel to a chamber 69 that is in registry with a valve element 71.

The valve element 71 is normally held in a closed position by means of an armature 72 that is biased by means of a biasing spring 73 to this closed position. The armature 72 is slidably supported within a sleeve 74 that is surrounded by a solenoid coil 75. The solenoid coil 75 is actuated in a suitable manner so as to open the valve element 71 when enrichment is desired so as to permit fuel to flow to a discharge nipple 76 and then through a conduit 77 to an inlet fitting 78 in the spacer plate 52. This fuel inlet discharges into one or more nozzle portions that communicate with the balance passageways 54, and/or 55, and/or 56 for delivery to the individual cylinders of the engine as described in aforenoted application Ser. No. 345,614.

Referring now in detail to FIGS. 3 through 6, the construction and operation of the valve assembly 68 will be described. The valve assembly 68 includes an outer housing 79 defining an internal chamber in which a valving member 81 is slidably supported. The valving member 81 carries a pair of spaced apart O-ring seals 82 for sealing the bore of this chamber and is connected to an actuating rod 83 having a manual knob portion 84 for manual positioning. The rod 83 has three detent recesses 85 that are adpated to be engaged by a detent ball 86 carried by the housing 79 to lock the valve member 81 in one of three selective positions.

A first inlet port 87 is formed at one end of the chamber in which the valve member 81 is positioned and this communicates with the discharge side of the pump 58 through a conduit 88. There is provided a first outlet nipple 89 that communicates with the valve chamber 69 through a conduit 91. The outlet 89 is disposed adjacent the inlet 87. A second outlet 92 communicates with the valve assembly 57 downstream of the valve element 71 through a conduit 93. In the position of the valve as shown in FIG. 3, which corresponds to the position shown in the schematic view of FIG. 4, communication between the passageways 87 and 89 is provided so that the pump chamber directly communicates with the well 69 and the system can operate in a fully automatic mode.

Figure 5:
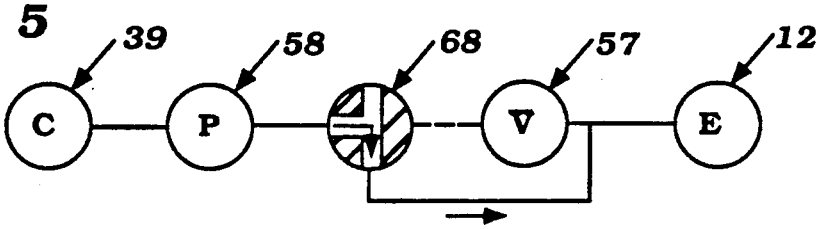
FIG. 5 is a schematic view, in part similar to FIG. 4, showing the valve in a position for manual override for manual fuel enrichment.

If, however, it is desired to bypass the automatic valve element 71 and provide fuel enrichment regardless of the condition of the valve element 71, the knob 84 is moved to the right as seen in FIG. 3 so as to move the valve to the position shown schematically in FIG. 5 so that the port 89 and 92 may communicate directly with each other. In this condition, the valve element 74 is bypassed and manual fuel enrichment will be provided.

Figure 6:
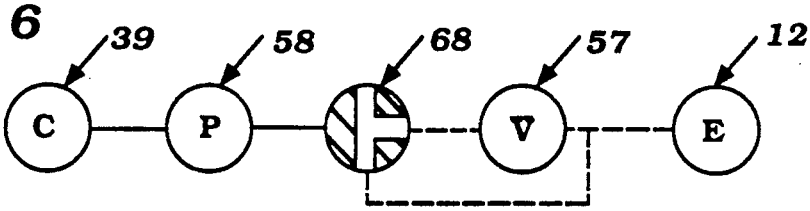
FIG. 6 is a schematic view, in part similar to FIG. 4 and 5, showing the valve in a position to shut off fuel supply regardless of the condition of the automatic valve.

If it is decided that no enrichment is required or if the valve element 71 is inadvertently stuck in an open position and enrichment is desired to be discontinued, the knob 83 is moved to the left from the position shown in FIG. 3 to that position shown schematically in FIG. 6 wherein communication of the conduit 88 with either the ports 89 or 92 is precluded. In this way, no fuel can flow to the valve 57 and the device will be shut off.

When the fuel is being supplied to the engine from the enrichment mechanism described, initially fuel will be supplied rapidly as the level of fuel in the fuel well 61 is depleted. However, once the amount of fuel in the fuel well 61 is depleted, then the amount of enrichment fuel supplied will be governed by the size of the metering jet 62. As a result, a larger than normal amount of fuel may be supplied for initial priming and then a smaller amount of enrichment is incorporated for cold warm up.

In the embodiment thus far described, the manual override valve 68 was positioned between the supplemental pump 58 and the control valve 57. It is to be understood, however, that the valve 68 can be positioned between the control valve 57 and the engine 12 as shown schematically in FIG. 7. Also, this system can be used regardless of where the pump 58 is positioned.

Figure 8:
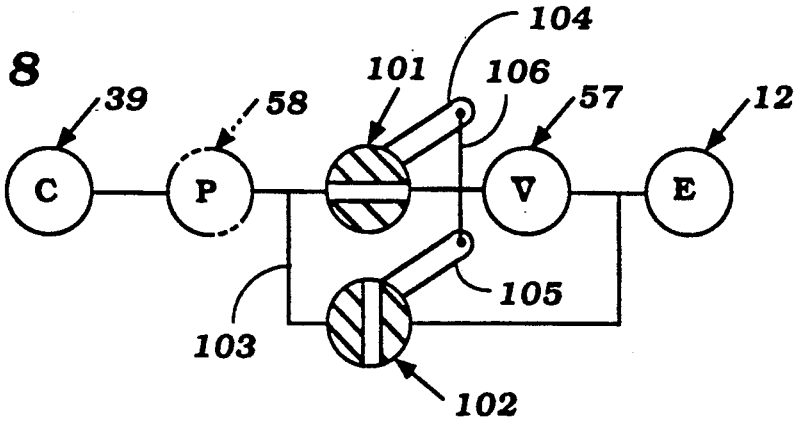
FIG. 8 is a schematic view of still another embodiment of valve arrangement.

In the embodiments thus far described, a single control valve 68 has been provided. However, the invention can be also utilized in conjunction with an embodiment wherein there are two control valves that are interlinked so as to provide the desired control function and FIG. 8 shows such an embodiment. The valve assembly includes a first valve member 101 that is positioned in a conduit interconnecting the pump 58 with the control valve 57. A second valve element 102 is provided in a bypass conduit 103 that connects the pump 58 directly with the engine 12 downstream of the control valve 57. The valves 101 and 102 have respective operators 104 and 105 that are linked together by means of a link 106. The valve members 101 and 102 are interrelated so that when one valve member is open the other is closed and vice versa. As a result, when the position is as shown in FIG. 8 the system will operate automatically. However, if the valves are moved to an intermediate position wherein both the valves 101 and 102 are closed, no enrichment will be permitted regardless of the condition of the automatic valve 57. However, if the valves 101 and 102 are moved further then the valve 101 will remain closed while the valve 102 will open and fuel enrichment is provided regardless of the condition of the automatic valve 57.

Figure 7:
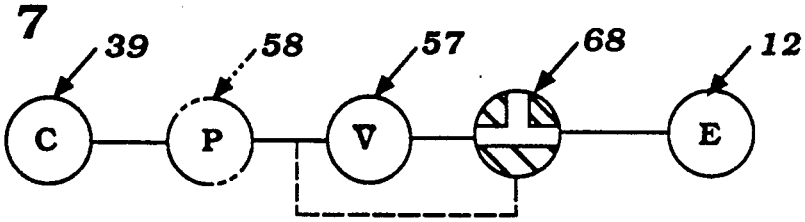
FIG. 7 is a schematic view of a valve arrangement constructed in accordance with another embodiment of the invention.
Figure 9:
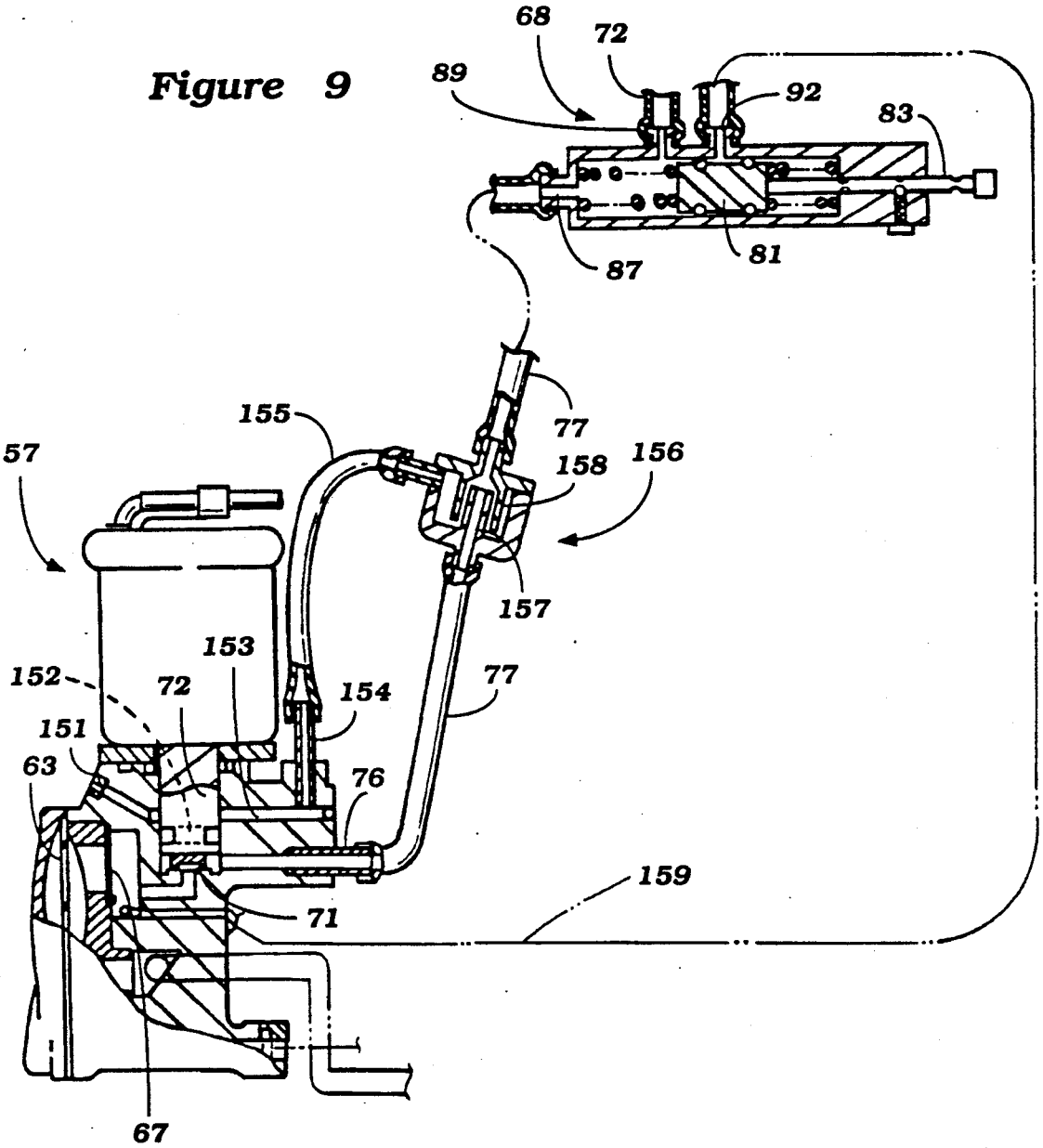
FIG. 9 is a view, in part similar to FIG. 3, showing yet another embodiment of the invention.

In the embodiments of the invention thus far described, the system is provided with an arrangement for automatically or manually adding additional fuel to the engine under certain conditions. When additional fuel is provided, it is also desirable to provide additional air so as to maintain the proper air fuel ratio and FIG. 9 shows such an embodiment. In this embodiment, the control valve 68 is also positioned in the location as shown in FIG. 7 (downstream of the automatic control valve 57). Because of the similarities of this embodiments to the previously described embodiments, those components which are the same have been identified by the same reference numerals and will not be described again, except insofar as is necessary to understand the construction and operation of this embodiment.

In this embodiment, the valve housing is provided with an atmospheric air port that is supplied with a metering jet 151. This port intersects, at times, a relief groove 152 formed in the valve armature 71 which normally closes the communication of the atmospheric port with an atmospheric supply passage 153. The atmospheric supply passage 153 is opened to communication with the metering jet 151 when the valve element 71 is opened and additional air will be supplied to an air outlet 154. The air outlet 154 communicates through a conduit 155 with a venturi type pumping device 156 to which fuel is supplied from the discharge port 76 through a first portion of the conduit 77. This ends up in a discharge 157 of a venturi section 158 so as to draw air into the system when the valve 71 is opened. This air and fuel mixture is then delivered through an extension of the conduit 77 to the port 87 of the valve 68.

When the valve 68 is in the position shown in FIG. 9, normal automatic enrichment is provided because fuel can flow from the conduit 77 into the valve housing port 87 and exit from the port 89 directly to the fitting 78 of the spacer 52. If, however, the valve element 71 is stuck in a closed position and enrichment is desired, the valve member 81 is pulled to the right so as to open communication of the port 92 which receives fuel from the pumping chamber through a conduit 159 so as to flow to the engine through the port 89.

It it is desired to shut off the fuel enrichment even when the valve member 71 is opened, the valve member 81 is moved to the extreme left hand position so as to shut off communication of the port 87 with both the ports 89 and 92.

It should be readily apparent from the foregoing description that several embodiments of the invention have been illustrated and described and each of which is highly effective in providing automatic fuel enrichment if desired but also wherein there can be a manual override of the automatic fuel control so as to provide manual fuel delivery or no fuel delivery, which ever condition is desired. Although a number of embodiments of the invention have been illustrated and described, various changes and modifications may be made without departing from the spirit and scope of the invention, as defines by the appended claims.

We claim:

1. A fuel feed system for an internal combustion engine comprising a fuel source, a fuel discharge for delivering fuel to said engine, automatic valve means for automatically controlling the communication of said fuel source with said fuel discharge for delivering fuel to said engine in response to a sensed condition, and manually operated valve means for selectively communicating said fuel source with said fuel discharge for fuel enrichment regardless of the condition of said automatic valve means and for precluding delivery of fuel from said source to said fuel discharge regardless of the condition of said automatic valve means for precluding any fuel enrichment.

2. A fuel feed system for an internal combustion engine as set forth in claim 1 wherein the manually operated valve means comprises a three way, three port valve.

3. A fuel feed system for an internal combustion engine as set forth in claim 1 wherein the manually operated valve means is positioned in a circuit between the fuel source and the automatic valve means.

4. A fuel feed system for an internal combustion engine as set forth in claim 3 wherein the manually operated valve means comprises a three way, three port valve.

5. A fuel feed stystem for an internal combustion engine as set forth in claim 1 wherein the manually operated valve means is positioned in a circuit between the automatic valve means and the fuel discharge.

6. A fuel feed system for an internal combustion engine as set forth in claim 5 wherein the manually operated valve means comprises a three way, three port valve.

7. A fuel feed system for an internal combustion engine as set forth in claim 1 further including a main charge forming device for supplying fuel from the fuel source to the engine with the fuel discharge being a supplemental fuel discharge.

8. A fuel feed system for an internal combustion engine as set forth in claim 7 wherein there are a plurality of combusion chambers each served by a main charge former and further including balance passage means interconnecting the induction passages leading to the individual chambers and wherein the fuel discharge discharges into the balance passage means.

9. A fuel feed system for an internal combustion engine as set forth in claim 8 wherein the manually operated valve means comprises a three way, three port valve.

10. A fuel feed system for an internal combusion engine as set forth in claim 8 wherein the manually operated valve means is positioned in a circuit between the fuel source and the automatic valve means.

11. A fuel feed system for an internal combustion engine as set forth in claim 10 wherein the manually operated valve means comprises a three ways, three port valve.

12. A fuel feed system for an internal combusion engine as set forth in claim 8 wherein the manually operated valve means is positioned in a circuit between the automatic valve means and the fuel discharge.

13. A fuel feed system for an internal combusion engine as set forth in claim 12 wherein the manually operated valve means comprises a three way, three port valve.

* * * * *